US006718926B2

(12) United States Patent
Yokochi et al.

(10) Patent No.: US 6,718,926 B2
(45) Date of Patent: Apr. 13, 2004

(54) STARTER MOTOR HAVING LABYRINTH VENTILATION PASSAGE

(75) Inventors: Yoshikazu Yokochi, Nagoya (JP); Masayuki Tomura, Kariya (JP)

(73) Assignee: Denso Corporation, Kariya (JP)

( * ) Notice: Subject to any disclaimer, the term of this patent is extended or adjusted under 35 U.S.C. 154(b) by 225 days.

(21) Appl. No.: 09/977,683

(22) Filed: Oct. 16, 2001

(65) Prior Publication Data

US 2002/0046722 A1 Apr. 25, 2002

(30) Foreign Application Priority Data

Oct. 19, 2000 (JP) ..... 2000-319266

(51) Int. Cl.[7] ..... F02N 17/00

(52) U.S. Cl. ..... 123/179.25; 123/185.6; 123/184.52; 60/788; 74/7 A

(58) Field of Search ..... 123/179.25, 179.29, 123/185.1, 185.6, 184.52, 179.28; 60/788; 74/6, 7 A

(56) References Cited

U.S. PATENT DOCUMENTS 4,274,292 A * 6/1981 Arnett, Jr. ..... 74/6
4,362,065 A * 12/1982 Baratti ..... 74/7 A
4,931,680 A * 6/1990 Sugiyama ..... 310/83
5,012,686 A * 5/1991 Morishita et al. ..... 74/7 A
5,345,901 A * 9/1994 Siegenthaler et al. .... 123/179.3
5,494,010 A * 2/1996 Niimi et al. ..... 123/179.25

FOREIGN PATENT DOCUMENTS

JP A-7-103116 4/1995

* cited by examiner

*Primary Examiner*—Willis R. Wolfe
*Assistant Examiner*—Johnny H. Hoang
(74) *Attorney, Agent, or Firm*—Posz & Bethards, PLC

(57) ABSTRACT

An inside space of a starter motor having a motor, a magnetic switch and a reduction gear train is ventilated through a ventilation passage formed in the starter motor. The ventilation passage includes a labyrinth passage formed at a portion connecting a front housing containing the reduction gear and a center housing containing the motor and the magnetic switch. The labyrinth passage connecting a motor chamber and a switch chamber prevents brush dusts generated in the motor chamber from being scattered in the other spaces. Grease splash from the gear train does not enter into the ventilation passage separated the gear train. Thus, the ventilation passage well functions for a long time without being clogged with the grease, brush dusts or the mixture thereof.

5 Claims, 6 Drawing Sheets

STARTER MOTOR HAVING LABYRINTH VENTILATION PASSAGE

CROSS-REFERENCE TO RELATED APPLICATION

This application is based upon and claims benefit of priority of Japanese Patent Application No. 2000-319266 filed on Oct. 19, 2000, the content of which is incorporated herein by reference.

BACKGROUND OF THE INVENTION

1. Field of the Invention

The present invention relates to a starter motor for cranking an internal combustion engine, the starter motor including a labyrinth-shaped ventilation passage.

2. Description of Related Art

An example of a starter motor having a ventilation passage is disclosed in JP-A-7-103116. A relevant portion of the starter motor is illustrated in FIG. 6. Cavities 110 are formed in a clutch case 100, an inner space of the starter motor (a motor chamber) communicates with outside through the cavities 110 and a clutch chamber 120. In this manner, a ventilation passage connecting the inner space of the starter motor to the outside can be made long and complex, and accordingly it is possible to prevent outside water from entering into the inner space of the starter motor through the ventilation passage.

In the conventional motor, however, a communicating hole 130 connecting the cavities 110 to the clutch chamber 120 is positioned at an outer peripheral portion of a reduction gear 140 that is housed in an upper portion of the clutch chamber 120. Therefore, there is a problem that the communicating hole 130 is closed by lubricating grease scattered from the rotating gear 140. Moreover, brush dusts generated in the motor chamber enter into the clutch chamber 120 through the ventilation passage and mixes with the grease. The reduction gear 140 and associated parts are abnormally abraded by the brush dusts mixed with the grease. Further, there is a possibility that the brush dusts contained in ventilation air adhere to and close the ventilating hole 130.

SUMMARY OF THE INVENTION

The present invention has been made in view of the above-mentioned problem, and an object of the present invention is to provide an improved ventilation passage in the starter motor, so that the ventilation passage is not clogged with the scattered grease, and the brush dusts generated in the motor chamber is prevented from being scattered in the ventilation passage.

The starter motor is composed of a motor for generating a rotational torque for cranking an internal combustion engine, a magnetic switch for supplying electric power from a battery to the motor, and a reduction gear train for transferring a rotational torque of the motor to the engine. An inside space of the starter motor is ventilated by air flowing through a ventilation passage that is open to outside of the starter motor. The ventilation passage includes a communicating passage connecting a switch chamber containing the magnetic switch therein and a motor chamber containing the motor therein.

The communicating passage is formed along a boundary surface between a front housing containing the reduction gear train and a center housing having the motor space and the switch space. Cavities formed in the front housing and cavities formed in the center housing are positioned to partially overlap one another when both housings are connected. The cavities overlapped in this manner form a labyrinth passage. The communicating passage that includes the labyrinth passage is formed around the reduction gear train, and the gear train is separated from the communicating passage by a separating wall.

When the motor rotates upon actuation of the magnet switch, pressure inside the motor chamber and switch chamber vibrates, and the inside air is heated. The heated air is ventilated through the ventilation passage. The labyrinth passage formed in the communicating passage prevents brush dusts generated in the motor chamber from being scattered in the ventilation passage and being mixed with grease lubricating the reduction gear train. Further, since one of the cavities constituting the labyrinth passage is positioned at the bottom of the front housing, the brush dusts are kept therein. Since the ventilation passage is separated from the reduction gear train, the grease splash from the gear train does not enter into the ventilation passage.

The ventilation passage according to the present invention is kept free from the grease and the brush dusts without being clogged therewith. The inside space of the starter motor is well ventilated by the air flowing through the ventilation passage.

Other objects and features of the present invention will become more readily apparent from a better understanding of the preferred embodiment described below with reference to the following drawings.

DETAILED DESCRIPTION OF THE PREFERRED EMBODIMENT

Figure 1:
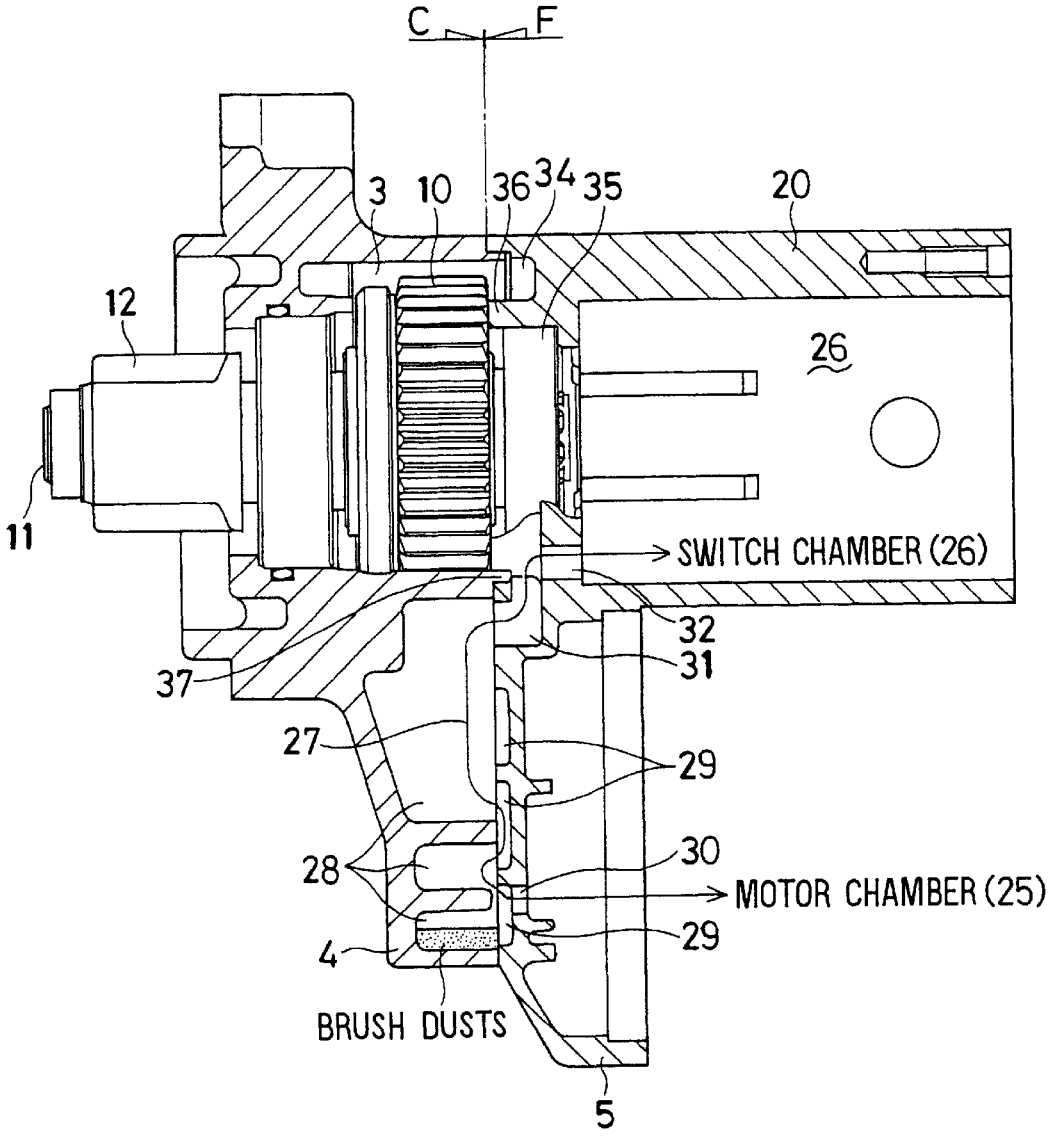
FIG. 1 is a cross-sectional view showing a front housing and a center housing of a starter motor according to the present invention, taken along line I-I shown in both FIGS. 2 and 3.
Figure 2:
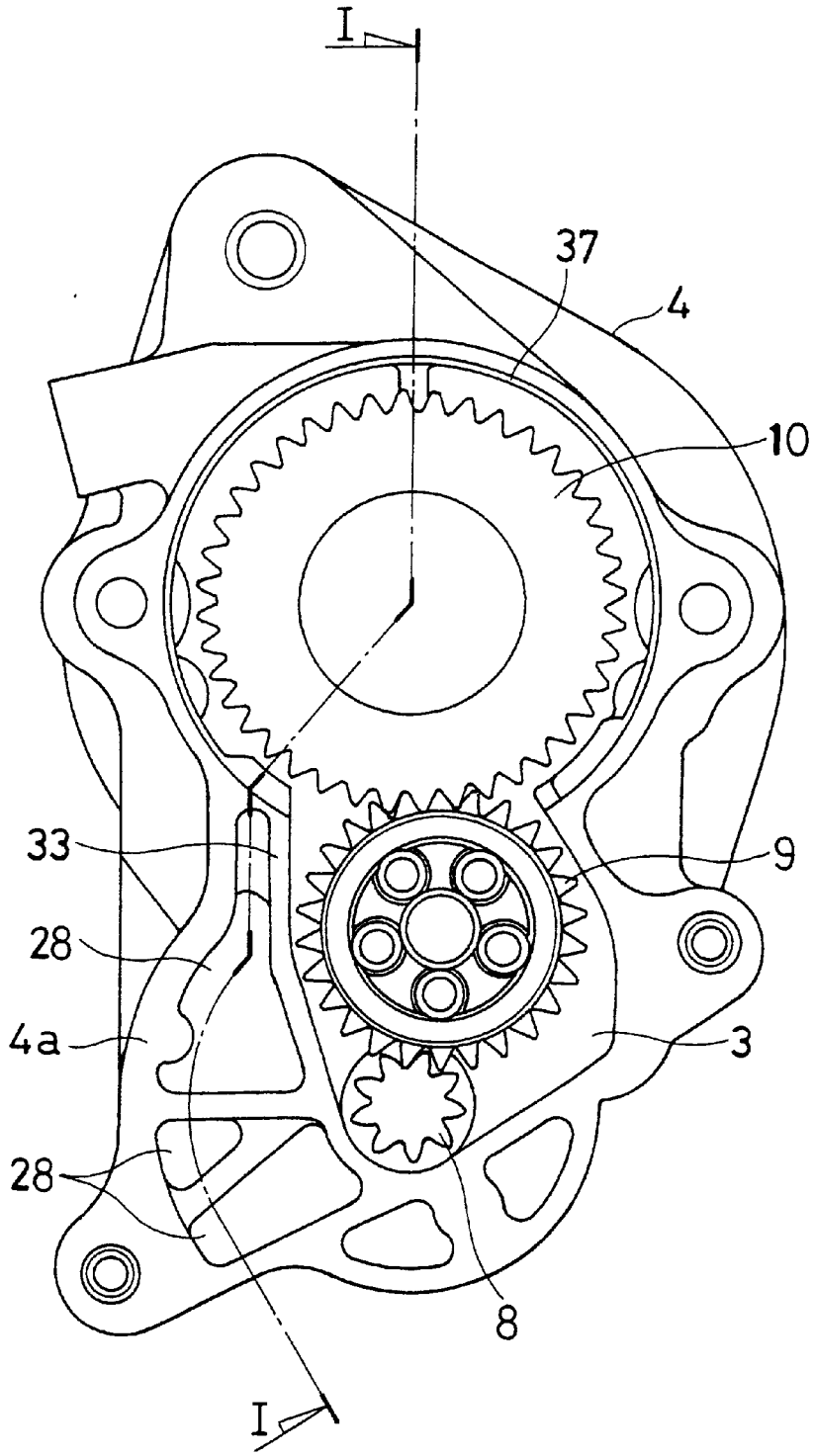
FIG. 2 is a plan view showing the front housing in which a gear chamber is formed, viewed in direction F shown in FIG. 1.
Figure 3:
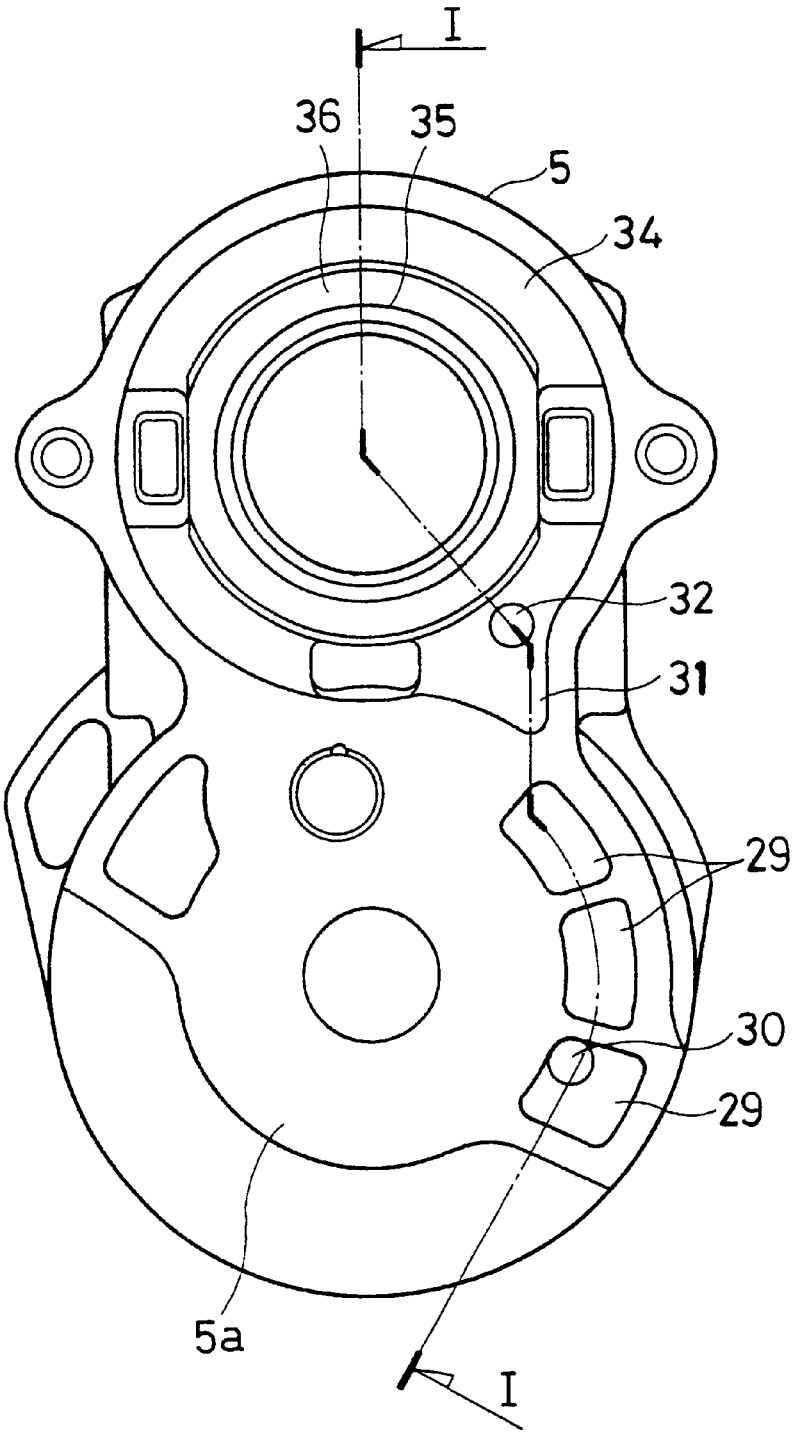
FIG. 3 is a plan view showing the center housing, viewed in direction C shown in FIG. 1.
Figure 4:
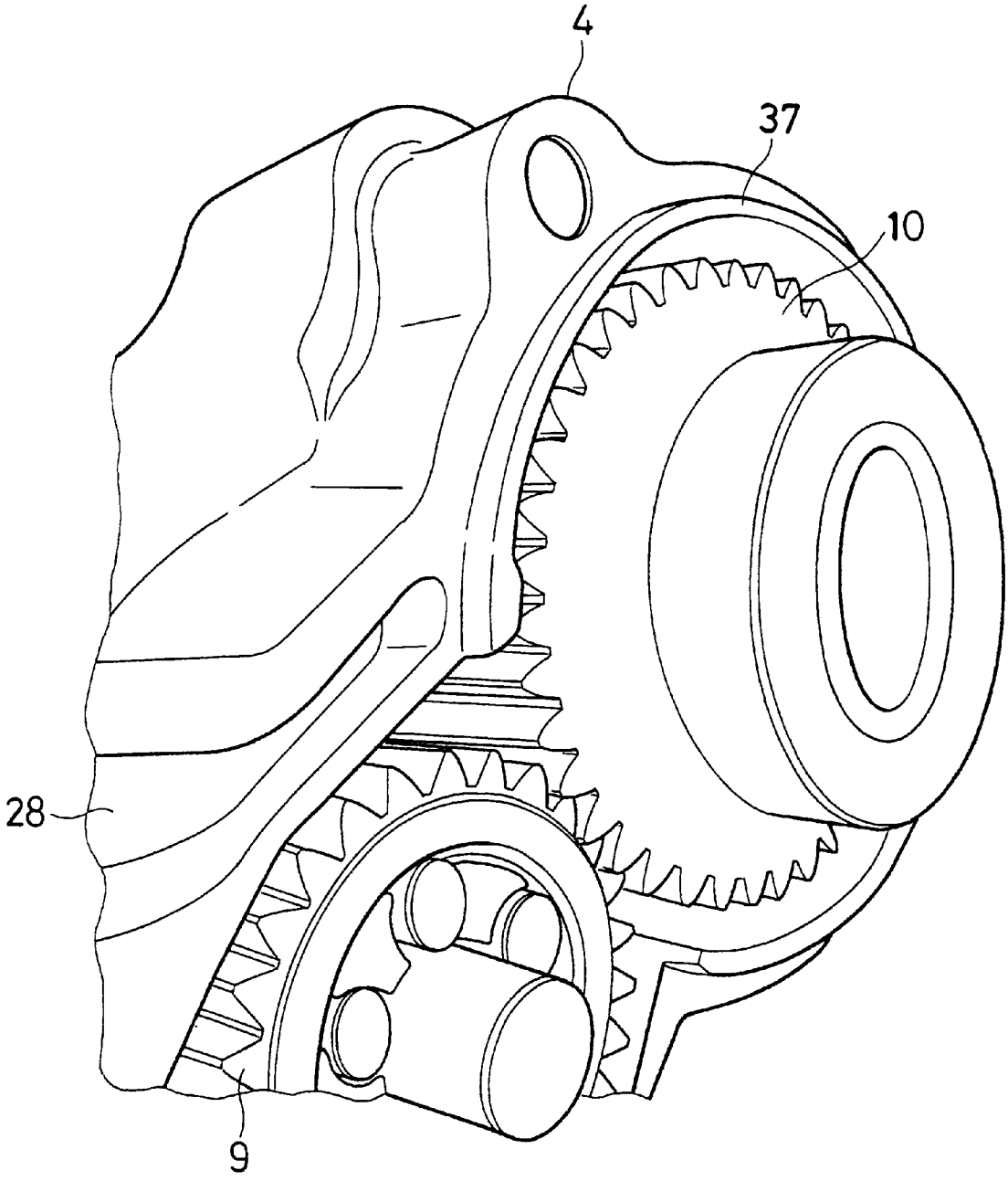
FIG. 4 is a perspective view showing the front housing and a gear train housed therein.
Figure 5:
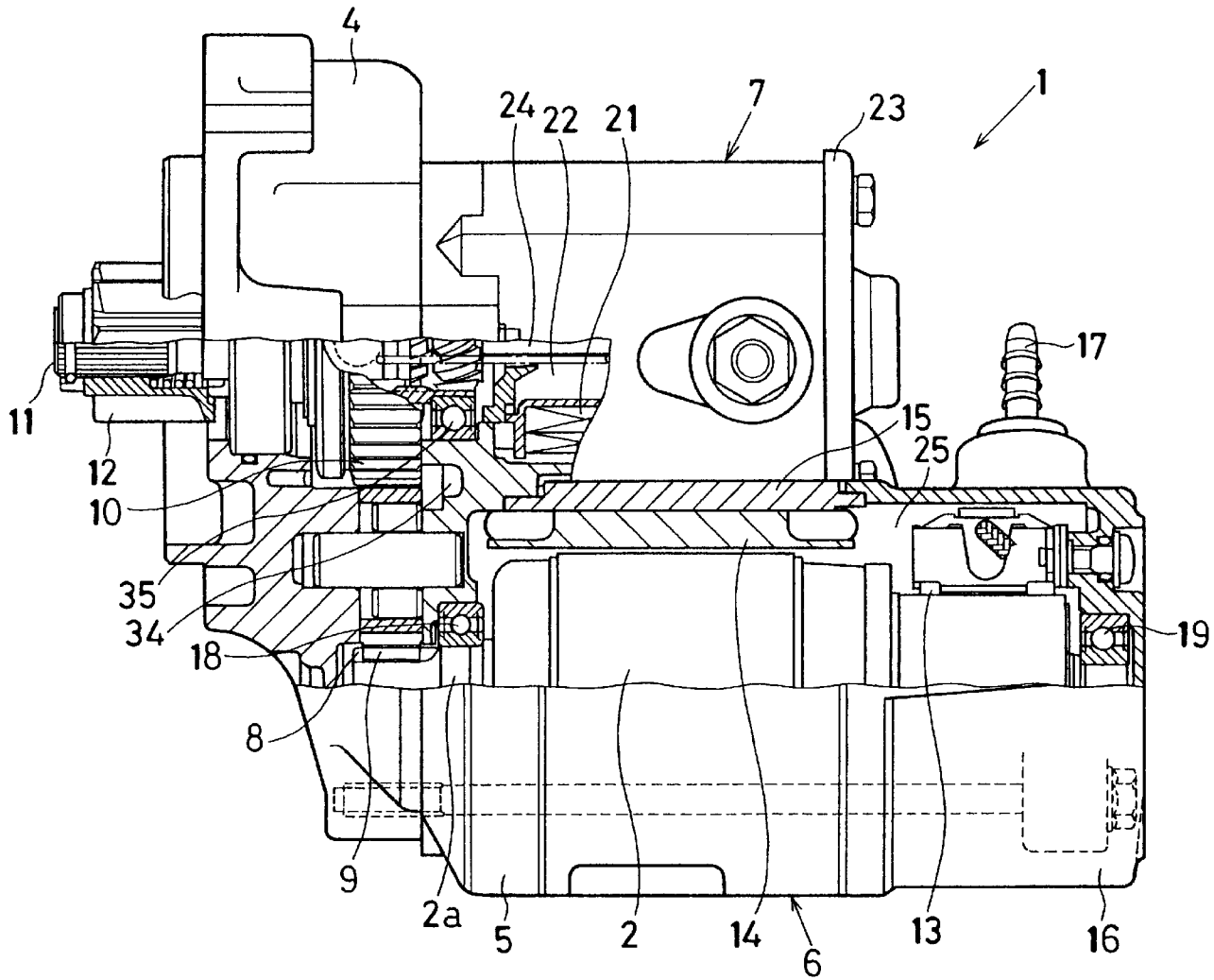
FIG. 5 is a side view, partly cross-sectioned, showing an entire structure of the starter motor according to the present invention.
Figure 6:
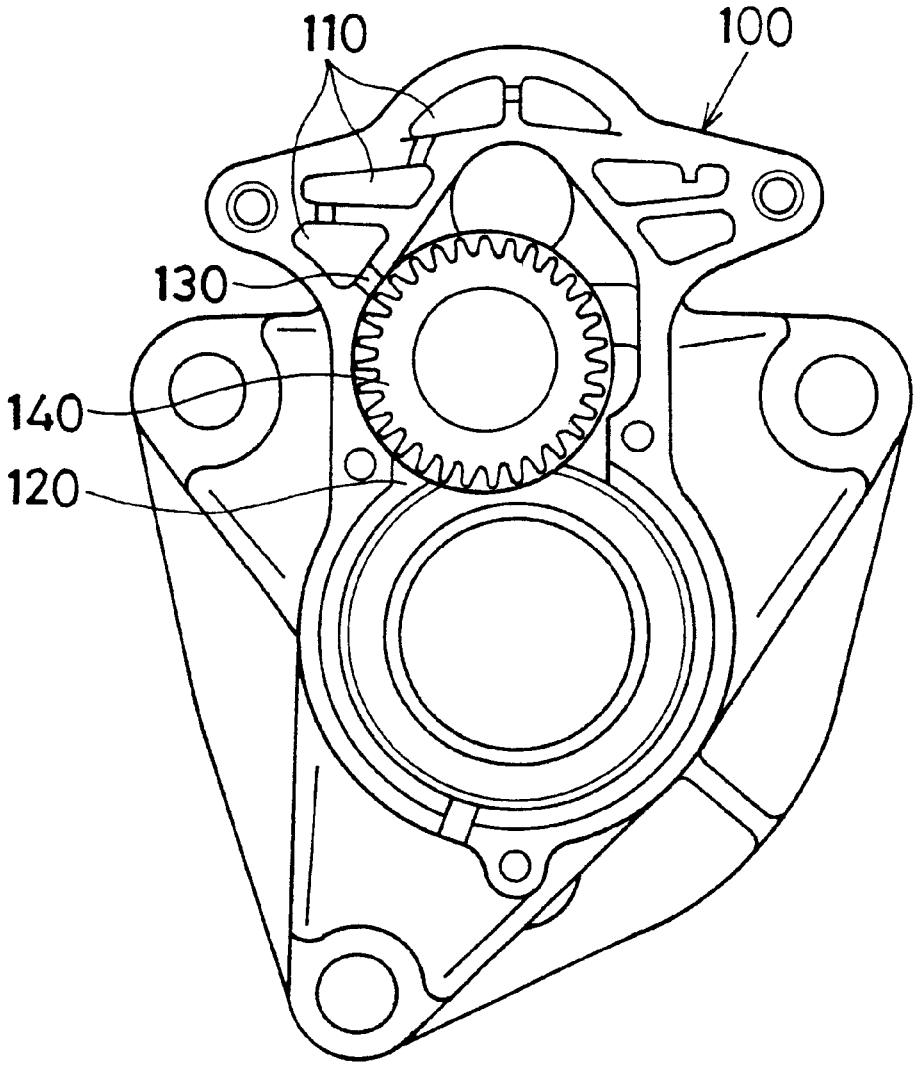
FIG. 6 PRIOR ART
FIG. 6 is a plan view showing a clutch case of a conventional starter motor.

A preferred embodiment of the present invention will be described with reference to FIGS. 1–5. FIG. 5 shows an entire structure of a starter motor 1 according to the present invention. FIG. 1 shows a cross-sectional view of a front housing 4 and a center housing 5, in which a communicating passage 27 as a part of a ventilation passage is formed. FIG. 2 shows a plan view of the front housing 4, viewed in direction F shown in FIG. 1, in which a gear train having three gears 8, 9 and 10 is housed. FIG. 3 shows a plan view of the center housing 5, viewed from direction C shown in FIG. 1. FIG. 4 is a perspective view showing the front housing 4 and the gear train.

As shown in FIG. 5, the starter motor 1 is composed of a motor 6 having an armature 2, a magnetic switch 7 and a reduction gear train. The motor 6 and the magnetic switch 7 are combined together, so that both axes extend in parallel to each other. The armature 2 is housed in a space formed by the front housing 4, a yoke 15 and a end cover 16. The magnetic switch 7 is housed in the center housing 5 forming a switch case 20, the rear end of the center housing 5 being closed with an end plate 23. The gear train is contained in the front housing 4.

The reduction gear train is composed of, as shown in FIG. 2, a drive gear 8 connected to an armature shaft 2*a*, an idle gear 9 engaging with the drive gear 8 and a clutch gear 10 engaging with the idle gear 9. A rotational speed of the armature 2 is reduced and its rotational torque is increased by the gear train. The rotational torque of the clutch gear 10 is transferred to a pinion shaft 11 via a one-way clutch (not shown) installed inside the clutch gear 10. A pinion gear 12 spline-connected to the pinion shaft 11 is rotated by the pinion shaft 11.

As shown in FIG. 5, the motor 6 is composed of the armature 2, brushes 13 and other components housed in a motor housing. The motor housing is composed of a cylindrical yoke 15 carrying stationary poles 14 positioned around the armature 2, the center housing 5 closing a front opening of the yoke 15, and the end cover 16 closing a rear opening of the yoke 15 and having a ventilating pipe 17. The armature 2 is rotatably supported by bearings 18 and 19 held in the center housing 5 and the end cover 16, respectively. Upon closing a motor switch (not shown) installed in the magnetic switch 7, electrical power is supplied to the armature 2 through the brushes 13, and thereby the armature 2 is rotated.

The magnetic switch 7 composed of a coil 21, a plunger 22 having a plunger rod 24, the motor switch and other components is installed in the switch case 20 integrally formed with the center housing 5 (refer to FIG. 1) The rear opening of the switch case 20 is hermetically closed with the end plate 23. Upon energization of the coil 21, the plunger 22 is driven by the magnetic force of the coil 21, thereby closing the motor switch and pushing the pinion shaft 11 frontward (to the leftward in FIG. 1). Upon de-energization of the coil 21, the plunger 22 returns to its original position, and thereby the motor switch is opened and the pinion shaft 11 returns to its original position.

As shown in FIG. 1, a communicating passage 27 forming a part of a ventilation passage in the starter motor 1 is formed along a surface connecting the front housing 4 and the center housing 5. The communicating passage 27 (shown with an arrowed line in FIG. 1) is composed of: cavities 28 formed in the front housing 4; cavities 29 formed in the center housing 5; a motor side ventilating hole 30 formed through a vertical wall of the center housing 5 as a passage between the lower cavities 28, 29 and a motor chamber 25; a communicating chamber 31 formed at a side of the gear chamber 3 and communicating with one of the cavities 28 positioned at a upper portion; and a switch side ventilation hole 32 as a passage between the communicating chamber 31 and a switch chamber 26. The motor chamber 25 formed in the motor housing and the switch chamber 26 confined by the switch case 20 and the end plate 23 communicate with each other through the communicating passage 27.

As shown in FIG. 2, the cavities 28 in the front housing 4 are formed along a bottom portion of the gear chamber 3 that contains the gear train therein. A rib 33 formed between the gear chamber 3 and the cavities 28 serves as a connecting surface 4*a* that abuts a connecting surface 5*a* of the center housing 5 (refer to FIG. 3). The cavities 28 are thus separated from the gear chamber 3 by the rib 33. As shown in FIG. 3, the cavities 29 in the center housing 5 are formed, being aligned along an arc line, on the connecting surface 5*a* that closes a front opening of the yoke 15. When both the front housing 4 and the center housing 5 are connected by abutting both connecting surfaces 4*a* and 5*a*, the cavities 28 and 29 are positioned not to completely overlap but to partly overlap each other. In this manner, the communicating passage 27 is formed as a labyrinth passage.

As shown in FIG. 1, the motor side ventilating hole 30 is formed through a vertical wall of the center housing 5 that closes the front opening of the motor chamber 25. The motor side ventilating hole 30 communicates with a cavity 29 positioned at the lowest.

The center housing 5 and the front housing 4 are connected by engaging a circular wall 37 formed at the rear opening of the front housing 4 with a circular groove 34 formed at the front opening of the center housing 5, as shown in FIG. 1. The circular groove 34 is formed outside of a circular bearing holder 36 that holds a bearing 35 therein. A portion of the circular groove 34 is enlarged toward the cavity 29 of the center housing 5, thereby forming the communication chamber 31, as shown in FIGS. 1 and 3. The communicating chamber 31 communicates with the cavity 28 of the front housing 4 and the switch side ventilating hole 32 formed through a front wall of the center housing 5.

The motor chamber 25 and the switch chamber 26 communicate with each other through the communicating passage 27 that includes the switch side ventilating hole 32, the communicating chamber 31, the cavities 28, 29, and the motor side ventilating hole 30. Thus, the ventilation passage in the starter motor 1 is formed. The ventilation passage further communicates with the ventilating pipe 17 connected to the end cover 16 (shown in FIG. 5).

As shown in FIGS. 2 and 4, one end of the circular wall 37 is extended to a position where the upper cavity 28 of the front housing 4 is separated from the gear chamber 3 by the end of the circular wall 37. The end of the circular wall 37 extends in the communicating chamber 31 when the front housing 4 and the center housing 5 are connected, as shown in FIG. 1.

The operation of the starter motor 1 including the magnetic switch 7 is not explained here because it is well known. The motor chamber 25 and the switch chamber 26 are ventilated through the ventilation passage described above in the following manner. The pressure in the switch chamber 26 varies when the plunger 22 is activated upon energization of the coil 21. A ventilating airflow is generated through the ventilation passage that includes the switch chamber 26, the communicating passage 27, the motor chamber 25 and the ventilating pipe 17. The communicating passage 27 includes the labyrinth structure formed by the cavities 28 of the front housing 4 and the cavities 29 of the center housing.

Since the communicating passage 27 connecting the switch chamber 26 and the motor chamber 25 is formed around the gear chamber 3 bypassing the gear chamber 3, the communicating passage 27 is not clogged with the lubricating grease of the reduction gear train if the grease is scattered due to its rotation. Therefore, the ventilation passage is always maintained in good conditions. Further, since the circular wall 37 extends into the communicating chamber 31, as shown in FIG. 1, the grease scattered by the rotation of gears 8–10 is prevented from entering into the cavities 28, 29.

The communicating passage 27 includes the labyrinth structure that is formed by positioning the cavities 28, 29 at offset positions not to completely overlap each other. Therefore, there is almost no chance for the brush dusts generated in the motor chamber 25 to enter into the gear chamber 3 or the switch chamber 26 through the labyrinth structure. As a result, the brush dusts do not mix with the grease, and accordingly abnormal attrition of the gears by the brush dusts is prevented. Further, since the brush dusts do not enter into the switch chamber 26, the sliding operation of the plunger 22 is not hindered by the brush dusts.

One of the cavities 28 formed in the front housing 4 and communicating with the motor side ventilating hole 30 is positioned at the lowest portion of the front housing 4. Therefore, the brush dusts entering into the lowest cavity 28 through the motor side ventilating hole 30 can be accumulated and kept therein. In this manner, the brush dusts are prevented from being scattered in the communicating passage 27, and the motor side ventilating hole 30 is not clogged by the brush dusts.

Though the magnetic switch 7 is positioned at an upper side of the motor 6 in the embodiment described above, the magnetic switch 7 may be positioned at an lower side of the motor 6. Though the ventilating pipe 17 is connected to the end cover 16 in the embodiment described above, it may be connected to the magnetic switch 7, for example, to the switch case 20.

While the present invention has been shown and described with reference to the foregoing preferred embodiment, it will be apparent to those skilled in the art that changes in form and detail may be made therein without departing from the scope of the invention as defined in the appended claims.

What is claimed is:

1. A starter motor for cranking an internal combustion engine, the starter motor comprising:

a motor having an armature for generating a rotational torque, the armature being housed in a motor chamber;

a magnetic switch for supplying electric power to the motor and for engaging the armature with the internal combustion engine to transfer the rotational torque of the armature to the internal combustion engine, the magnetic switch being housed in a switch chamber;

a reduction gear train for reducing rotational speed of the armature, the reduction gear train being housed in a gear chamber; and a ventilation passage formed in the starter motor for ventilating the motor chamber and the switch chamber, the ventilation passage including a communicating passage connecting the motor chamber and the switch chamber, the communicating passage being formed around the gear chamber bypassing the gear chamber.

2. A starter motor for cranking an internal combustion engine, the starter motor comprising:

a motor having an armature for generating a rotational torque, the armature being housed in a motor chamber;

a magnetic switch for supplying electric power to the motor and for engaging the armature with the internal combustion engine to transfer the rotational torque of the armature to the internal combustion engine, the magnetic switch being housed in a switch chamber;

a reduction gear train for reducing rotational speed of the armature, the reduction gear train being housed in a gear chamber; and a ventilation passage formed in the starter motor for ventilating the motor chamber and the switch chamber, the ventilation passage including a communicating passage connecting the motor chamber and the switch chamber, the communicating passage being formed around the gear chamber bypassing the gear chamber, wherein:

the gear chamber is formed with a front housing and a center housing, both housings being connected to each other by abutting connecting surfaces of both housings; and cavities are formed on each connecting surface, the cavities formed on the connecting surface of the front housing being positioned not to completely overlap but partially overlap the cavities formed on the connecting surface of the center housing, thereby forming a labyrinth passage.

3. The starter motor as in claim 2, wherein:

the communicating passage includes a switch side ventilating hole formed in the center housing for communicating with the switch chamber, a communicating chamber formed at a side of the gear chamber for connecting the motor side ventilating hole and the labyrinth passage, and a motor side ventilating hole formed in the center housing for connecting the labyrinth passage to the motor chamber.

4. The starter motor as in claim 3, wherein:

the front housing includes a circular wall for connecting the front housing to the center housing; and a part of the circular wall extends into the communicating chamber to separate the gear chamber from the cavities formed on the connecting surface of the front housing.

5. The starter motor as in claim 3, wherein:

the motor side ventilating hole is positioned at a lower position than the switch side ventilating hole; and one of the cavities formed on the connecting surface of the front housing is positioned at a lowest position of the front housing to accumulate and keep therein brush dusts generated in the motor chamber.

* * * * *